US008491332B1

(12) United States Patent
Mo et al.

(10) Patent No.: US 8,491,332 B1
(45) Date of Patent: Jul. 23, 2013

(54) SLIM C5/C6 COUPLER

(75) Inventors: YuanWen Mo, Singapore (SG); Mui Lian Jessica Toh, Singapore (SG)

(73) Assignee: Volex PLC, London (GB)

( * ) Notice: Subject to any disclaimer, the term of this patent is extended or adjusted under 35 U.S.C. 154(b) by 31 days.

(21) Appl. No.: 13/359,356

(22) Filed: Jan. 26, 2012

(51) Int. Cl.
*H01R 13/66* (2006.01)

(52) U.S. Cl.
USPC ..... 439/568

(58) Field of Classification Search
USPC ..... 439/668, 568, 101
See application file for complete search history.

(56) References Cited

U.S. PATENT DOCUMENTS

| | | | | |
|---|---|---|---|---|
| 3,611,261 | A * | 10/1971 | Gregory | 439/353 |
| 3,723,942 | A * | 3/1973 | Dennison | 439/97 |
| 3,794,957 | A * | 2/1974 | Winkler | 439/295 |
| 4,632,121 | A * | 12/1986 | Johnson et al. | 600/372 |
| 5,254,019 | A * | 10/1993 | Noschese | 439/681 |
| 6,095,870 | A * | 8/2000 | Lee | 439/681 |
| 7,121,899 | B2 * | 10/2006 | Homann et al. | 439/680 |
| 2005/0020133 | A1 | 1/2005 | Homann et al. | |
| 2009/0093160 | A1 | 4/2009 | Hsieh et al. | |

FOREIGN PATENT DOCUMENTS

| | | |
|---|---|---|
| DE | 91 05 135 U1 | 6/1991 |
| EP | 1 939 992 A2 | 7/2008 |
| EP | 2 194 617 A1 | 6/2010 |

OTHER PUBLICATIONS

"IEC 60320-1 Appliance couplers for household and similar general purposes—Part 1: General requirements", International Standard—IEC; Norme International—CEI; vol. 60320-1, No. Ed. 2.1, Nov. 1, 2007, 15 pages, XP009141157.

International Search Report and Written Opinion dated Oct. 4, 2012, issued for International Application No. PCT/EP2012/051207, 16 pages.

* cited by examiner

*Primary Examiner* — Phuong Dinh
(74) *Attorney, Agent, or Firm* — Woodcock Washburn LLP

(57) ABSTRACT

Embodiments relate to a C5/C6 coupler having a substantially equivalent shape and size as a C7/C8 coupler. Embodiments relate to a power supply cord that provides an earth connection to the cord. Still more particularly, embodiments relate to a slim inlet that provides a make-first-and-break-last earth connection and prevents incompatible cords, different type of connectors, from being connected to the slim inlet.

22 Claims, 20 Drawing Sheets

SLIM C5/C6 COUPLER

CROSS-REFERENCES TO RELATED APPLICATIONS

Not applicable.

BRIEF DESCRIPTION

A first advantage of a slim 3 terminal C6 AC inlet (from herein "slim inlet") for a slim C5 connector (from herein "slim connector") in accordance with an embodiment is that the housing of the Slim inlet has a slim profile that allows the housing to be incorporated into slim electronic devices. A second advantage of a slim connector in accordance with an embodiment is that an earth pin that does not contact the housing is provided to meet the necessary safety requirements for consumer use. A third advantage of a slim connector is that the housing of the slim inlet and/or configuration of the pins prevents other types of connectors from being connected to embodiments of the slim inlet.

In accordance with embodiments, a slim inlet includes a housing having a front side and a back side. A recessed cavity is formed in a surface of the front side of the housing. The recessed cavity has a first substantially circular portion on a first side of the cavity, a second substantially circular portion on a second side of the cavity, a substantially indented channel connecting the first and second substantially circular portions, and an elongated trench recessed in a sidewall of the substantially indented channel.

The slim inlet has a live pin, a neutral pin and an earth pin. The live pin is substantially cylindrical and has a first end that protrudes out of the housing into a first one of the first and second substantially circular portions of the cavity. The neutral pin is also substantially cylindrical and has a first end that protrudes out of the housing into a second one of the first and second substantially circular portions of the cavity. The earth pin is substantially flat and made of a bendable conductive material. The earth pin has a first end that protrudes out of the housing into the elongated trench in the side wall of the indented portion of the cavity and is configured to be deflectable in the trench. The earth pin is further configured in the trench such that the portion of the earth pin in the trench does not contact a surface of the trench when the pin is deflected.

In accordance with some of these embodiments, the earth pin has a hook portion. The hook portion extends out from the first end of the earth pin distal from the housing and folds under the first end of the pin. In accordance with some of these embodiments, the hook portion further includes a raised portion that juts out from the trench. In accordance with some of the embodiments, the earth pin also protrudes further out of the housing than the live pin and the neutral pin to facilitate make-first-and-break-last earth contact with a slim connector. In accordance with further embodiments, the earth pin may have a second end that protrudes out of an opening in the second side of the housing.

In accordance with some embodiments, the live pin and/or neutral pin are configured in the following manner. The pin has a body having a first end and a second end. The first end protrudes out of the housing into one of the substantially circular portions of the recessed cavity in the first side of the housing. A contact pad is connected to the second side of the pin and is exposed through an opening in the second side of the housing. In accordance with some of these embodiments, the contact pad includes a flat base that rests on the second end of the pin in a plane substantially perpendicular to a longitudinal axis of the pin. In accordance with further of these embodiments, a projection extends outward from an end of the base in a plane substantially parallel to the longitudinal axis of the pin in a direction that is distal from the pin body. Furthermore, the projection may have an end that extends out of the opening in the back side of the housing. The exposed end of the projection may include an aperture to facilitate connections.

In accordance with further embodiments, the recessed cavity prevents other types of connectors from being connected to the live pin and the neutral pin in the housing. In accordance with further embodiments, the live pin and the neutral pin are spaced apart in the housing to prevent other types of connector from being connected to the pins in the housing.

STATEMENTS AS TO THE RIGHTS TO INVENTIONS MADE UNDER FEDERALLY SPONSORED RESEARCH OR DEVELOPMENT

Not applicable.

REFERENCE TO A "SEQUENCE LISTING," A TABLE, OR A COMPUTER PROGRAM LISTING APPENDIX SUBMITTED ON A COMPACT DISK

Not applicable.

BACKGROUND

Many electronic devices have a removable electric power supply cord. Many types of connectors have been devised to connect the cord to the device, and as the size of such devices shrinks, the size of the connectors must be minimized to fit into the housing of the devices, eliminating the viability of many older and larger designs. Several types of connectors, including but not limited to C7 and C8 connectors, are designed with a slim profile to fit into such devices. These types of connectors provide a slim connector housing that provides connections that meet the safety requirements for two pin connectors. For purposes of this discussion, a two pin connector is a connector that only provides a connection between a live pin and a neutral pin through the connector.

Since many modern electrical devices incorporate sophisticated electronic circuits that can be very susceptible to static discharge, it is a problem that many types of slim connectors do not provide an earth pin for grounding the connected circuit. One problem with providing a slim connector with a slim profile is that the earth pin must be configured so as to not contact the surrounding housing to prevent the housing and any connected device from being damaged by a short in a connected circuit. Furthermore, the connector should prevent cords that are used for other types of connectors from being used with the connector to prevent users from plugging the wrong connector into the device, which can result in circuit overloads and shorts. Thus, those skilled in the art are constantly striving to provide a slim connector for power cords that meets all of the safety requirements needed for consumer use and includes an earth pin.

BRIEF DESCRIPTION OF THE SEVERAL VIEWS OF THE DRAWING

The above and other features and advantages of embodiments are described in the following detailed description and are shown in the following drawings.

DETAILED DESCRIPTION

An embodiment relates to a C5/C6 coupler having a shape and size substantially equivalent to C7/C8 coupler. More particularly, an embodiment relates to a power supply cord that provides an earth connection to the cord. Still more particularly, an embodiment relates to what is referred to as a slim inlet that provides a make-first-and-break-last earth connection and prevents incompatible cords, i.e., different type of connectors, from being connected to the slim inlet. In an embodiment, a slim inlet includes an AC inlet for a connector having a contact surface that is about 22 mm or less in width, and about 15 mm or less in height. However, changes to these dimensions can be made without departing from the present disclosure. Hence, it is to be understood that as long as the C6 inlet has a shape and size substantially equivalent to the shape and size of a C8 inlet, the actual dimensions may differ from those presented above.

Figure 1:
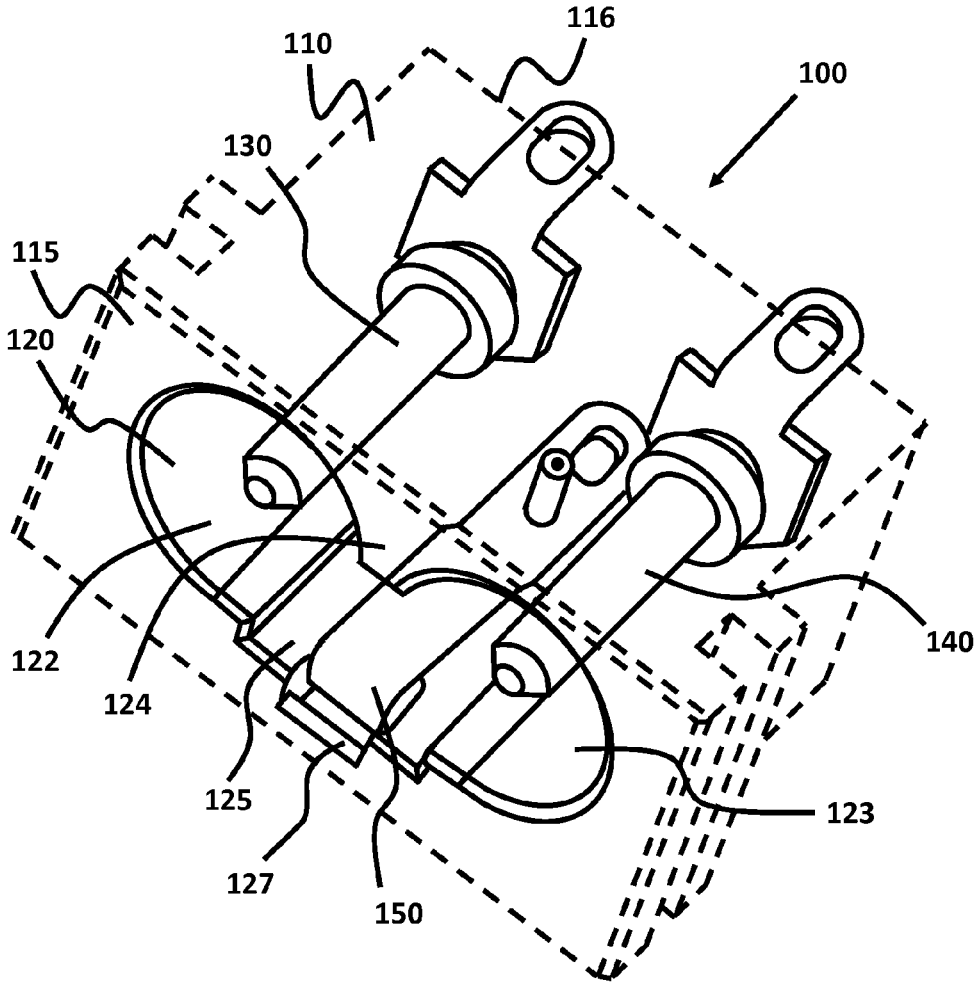
FIG. 1 illustrating a front perspective view of an embodiment of a slim inlet.

FIG. 1 illustrates slim inlet 100 in accordance with an embodiment. Slim inlet 100 includes housing 110 having front side 115 and back side 116. Housing 110 is made of plastic or some other form of non-conducting material. Housing 110 is shown to have a substantially cubic shape; however, one skilled in the art will recognize that housing 110 may be other geometrical shapes without departing from the disclosure. Housing 110 can have a width of about 22 mm or less, a height of about 15 mm or less, and a length of about 15 mm or less, but as noted above, other sizes are possible without departing from the disclosure. Embodiments of the slim inlet 100 provide an advantage over a traditional three pin C5/C6 coupler in that the smaller dimensions enable the slim inlet to be integrated into slimmer and smaller electronic devices.

Housing 110 includes recessed cavity 120 formed therein that starts or opens from the front side 115 of housing 110. Recessed cavity 120 extends about 10 mm deep from the surface of front side 115. Recessed cavity 120 includes two recessed portions formed by its side walls, a first substantially circular portion 122 formed on a first side of recessed cavity 120, and a second substantially circular portion 123 formed on a second side of recessed cavity 120. The housing 110 includes a truncated, substantially V-shaped portion 124 that extends between the first and second substantially circular portions 122 and 123 and helps to give portions 122 and 123 their substantially circular shape. The recessed cavity 120 also includes an indented portion or channel 125 opposite the V-shaped portion 124 formed between the first and second substantially circular portions 122 and 123. In embodiments, recessed cavity 120 is shaped so as to prevent other types of connectors (for safety purposes) from being used in conjunction with slim inlet 100. For example, a C1 connector or a C7 connector would not fit into recessed cavity 120 to prevent pins in these connectors from contacting the pins inside recessed cavity 120. One skilled in the art will recognize that other configurations that meet the above given criteria without departing from the disclosure are possible. Embodiments of the slim inlet also reject mating from other existing connectors by using a widened power pin pitch and a mismatched profile.

Trench 127 is an indenture formed in one of the side walls of indented portion 125 of recessed cavity 120. Trench 127 is approximately 3 mm wide and 1.3 mm in height. The exact sizing of trench 127 can be determined such that flexible earth spring 150, further described below, does not touch a sidewall of the trench 127 even when flexible earth spring 150 is at a maximum deflection. One skilled in the art will recognize that the exact sizing of trench 127 must be determined based upon the shape, length and elasticity of earth spring 150 and is left as a design choice to those skilled in the art.

As shown in FIG. 1, live pin 130 and neutral pin 140 protrude into the recessed cavity 120 from the back side 116 of housing 110. Live pin 130 protrudes into the first substantially circular portion 122 and neutral pin 140 protrudes into the second substantially circular portion 123. One skilled in the art will recognize that the configuration of the pins in the housing may be interchanged without departing from this disclosure.

Earth spring 150 has a first portion that extends out from the back side 116 to the front side 115 of the housing in trench 127. Earth spring 150 is formed from a piece of flexible conductive material. The shape of earth spring 150 is more fully described below, but its shape and design allows the earth spring 150 to flex or deflect within trench 127 in response to an appropriate connector being inserted in to the housing 110 of slim inlet 100. In one embodiment, earth spring 150 can be sized such that earth spring 150 does not contact any surface of trench 127 even when earth spring 150 reaches a maximum deflection. The protruding end of earth spring 150 can include a hook, such as illustrated in reference to FIG. 4. The hook is a portion of the pin that folds under the first portion to facilitate contact with the earth pin contact of an inserted connector. The hook can include a hump or portion of pin that juts upward from a top surface of earth spring 150 to facilitate make-first-and-break-last contact with the earth pin contact of an inserted connector. To further facilitate make-first-and-break-last contact, earth spring 150 can also protrude further out of the housing in recessed cavity 120 than both live pin 130 and neutral pin 140.

Figure 2:
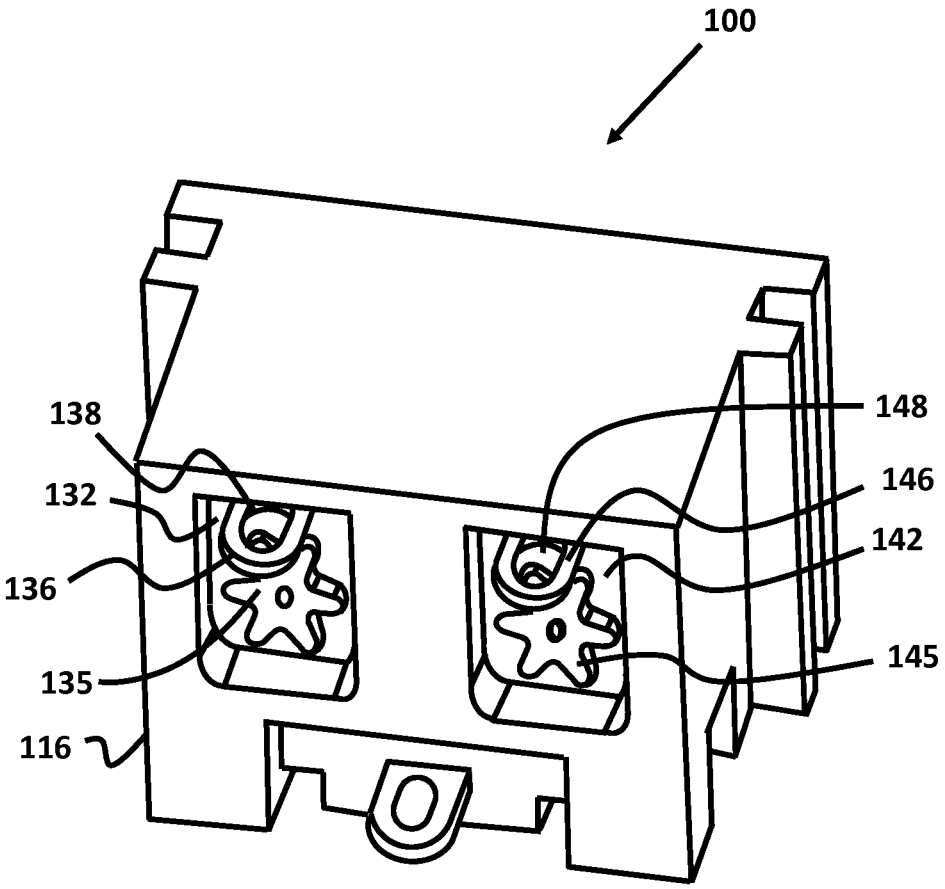
FIG. 2 illustrating a back perspective view of the embodiment of the slim inlet shown in FIG. 1.

FIG. 2 illustrates a rear view of slim inlet 100. Openings 132 and 142 are formed in back side 116 of housing 110. Opening 132 exposes contact pad 135 on the second end of live pin 130 and opening 142 exposes contact pad 145 on the second end of neutral pin 140. Contact pads 135 and 145 are each a flat piece of conductive material affixed to the second ends of live pin 130 and neutral pin 140, respectively. Contact pads 135 and 145 are oriented such that the surface of contact pads 135 and 145 are each substantially perpendicular to the longitudinal axis of the respective pins. As shown, each contact pad 135 and 145 may have a projection 136, 146 that extends outward from an end of the contact pad 135 and 145. Each projection 136, 146 extends outward from the pad in a plane substantially parallel to the longitudinal axis of the pins. Further each projection 136, 146 may have an opening 138, 148 defined in the projection to facilitate connections. A second end of earth pin 150 may also extend out of a bottom end of back side 116 and may also have an opening defined in the exposed end to facilitate a connection.

Figure 3:
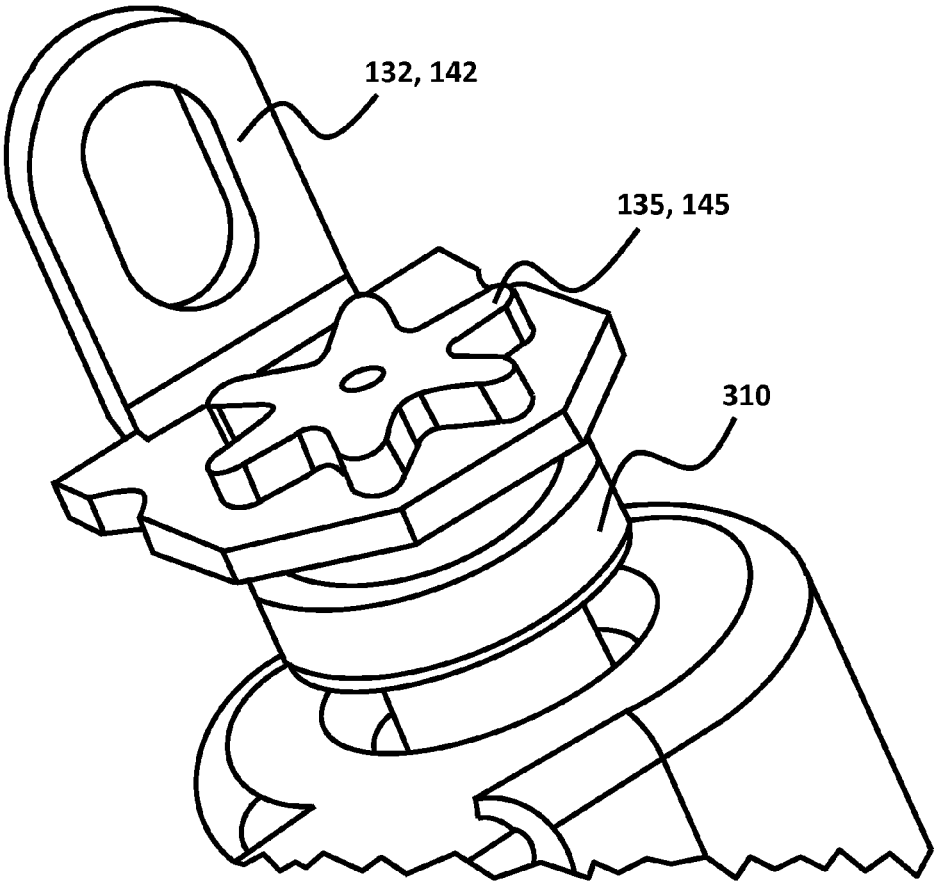
FIG. 3 illustrating an isolated view of a second end of a pin in accordance with the embodiment of the slim inlet shown in FIG. 1.

FIG. 3 illustrates a view of a second end of an exemplary live pin 130 and/or neutral pin 140. As can be seen from FIG. 3, an o-ring 310 may be affixed to the second end of the pin proximate the contact pad 135, 145. O-ring 310 allows the pin to be press fit into an opening through the housing to secure the pin in place in the housing. The use of the O-ring allows each pin to be inserted into the housing without contacting any surface of housing 110 to meet various safety requirements.

Figure 4:
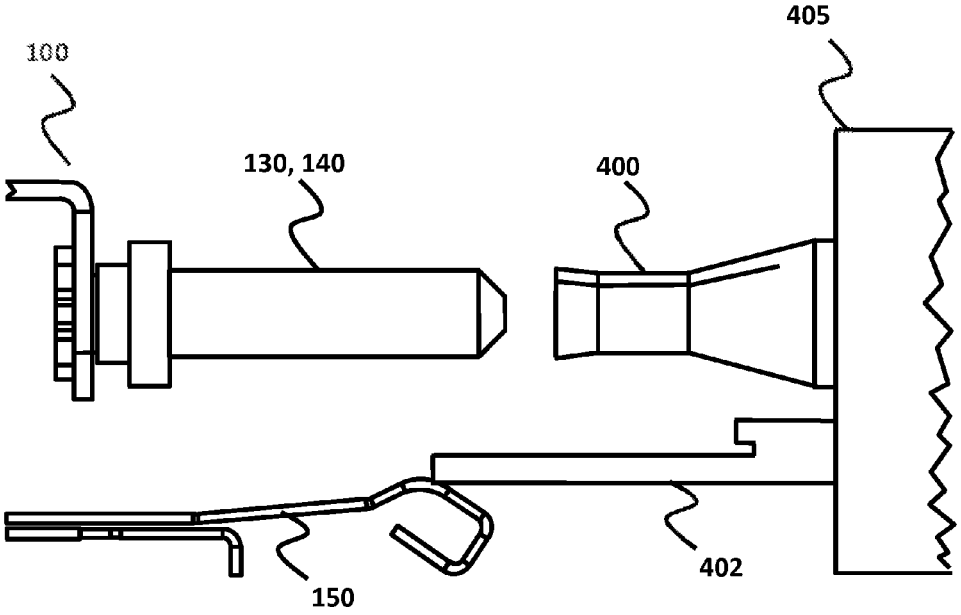
FIG. 4 illustrating a side cross sectional view of the slim inlet from FIG. 1 during an insertion of a slim connector wherein the pins of the slim inlet and the terminals of the slim connector are aligned.

FIG. 4 illustrates a cross sectional view of a second mating slim connector 405 about to be inserted into slim inlet 100, with housing 116 not shown to better illustrate the interaction between the earth spring 150 and pin 130, 140 of slim inlet 100 and the corresponding earth pin contact 402 and power socket 400 of the mating connector 405. As shown in FIG. 4, earth spring 150 makes contact with the earth pin contact 402 of the connector 405 being inserted into slim inlet 100 prior to any connection of the live and neutral pins with the respective live and neutral power sockets. This ensures that the circuit is grounded prior to the electrical connection being made between the slim inlet and the connector (or plug) for safety reasons. Further, one skilled in the art will recognize that when the connector 405 is removed, earth spring 150 will maintain contact with the earth pin contact 402 of the slim inlet 100 until after the live and neutral pins from the slim inlet 100 are separated from the corresponding live and neutral power sockets of the connector 405.

Figure 5:
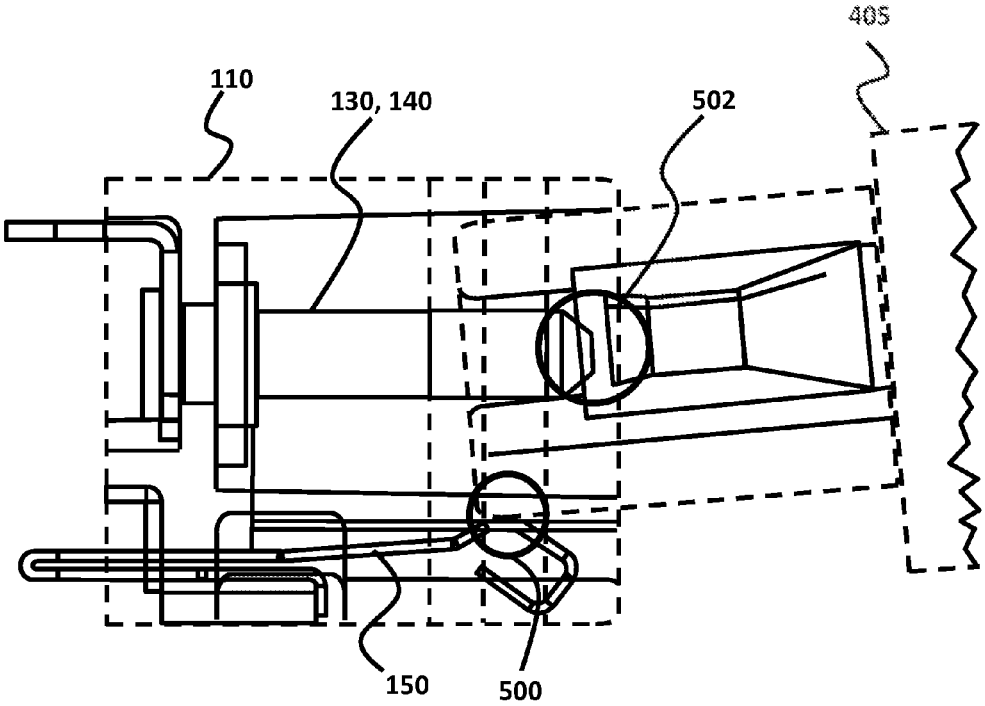
FIG. 5 illustrating a side cross sectional view of the slim inlet from FIG. 1 during an insertion of a slim connector at an downward angle.
Figure 6:
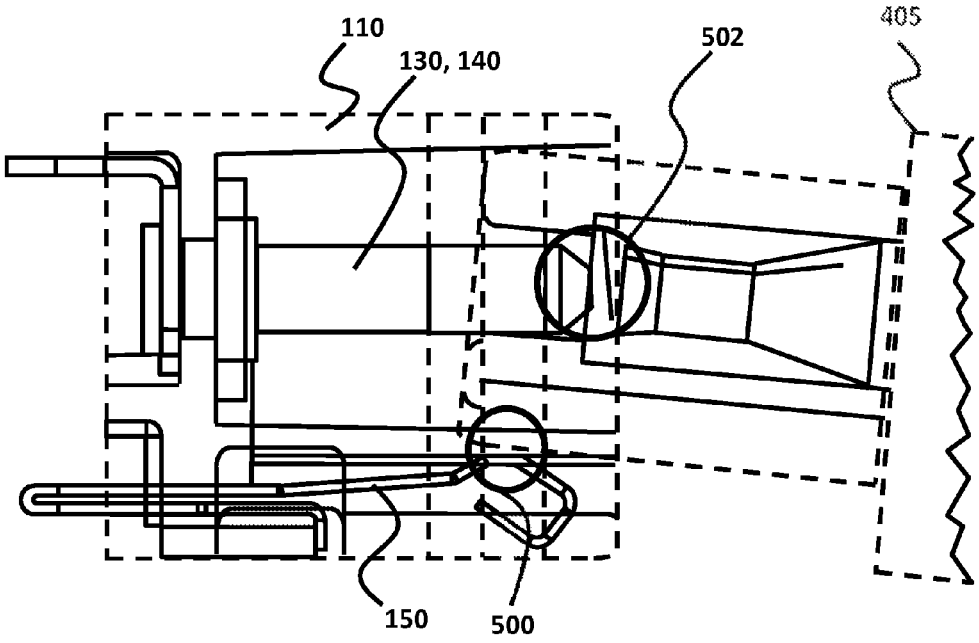
FIG. 6 illustrating a side cross sectional view of the slim inlet from FIG. 1 during an insertion of a slim connector at an upward angle.

FIGS. 5 and 6 further illustrate cross sectional views of a connector 405 being inserted into the slim inlet at different angles. As can be seen from FIGS. 5 and 6, the position and length of earth spring 150 causes the earth spring 150 to make first contact with the earth pin contact of the slim connector being inserted into the slim inlet regardless of the angle of insertion of the connector 405. In FIG. 5 the connector 405 is being inserted at a downward angle, while in FIG. 6 the connector 405 is being inserted at an upward angle. Circle 500 highlights the earth spring 150 making first contact with the earth pin contact, and circle 502 highlights the pin 130, 140 not yet having contact with the corresponding power socket.

Figure 7:
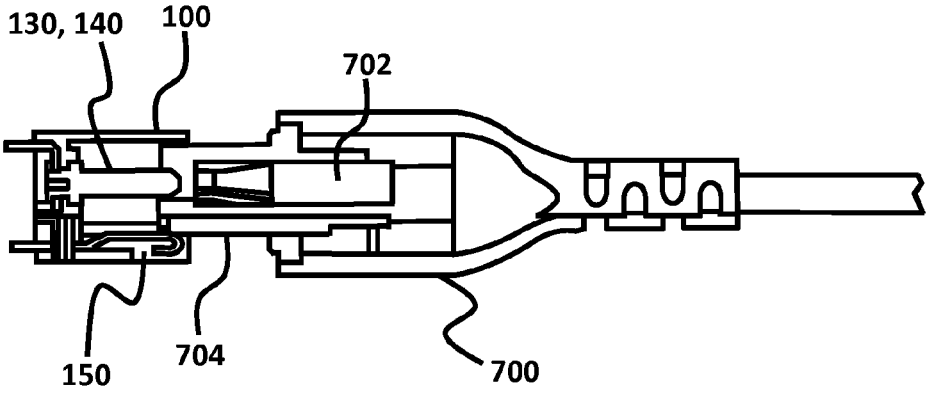
FIG. 7 illustrating a detailed, cross-sectional view of an embodiment of a slim connector being inserted into a slim inlet.

FIG. 7 illustrates a cross-sectional view of a slim connector 700 being inserted into slim inlet 100. The live pin 130 and neutral pin 140 of the slim inlet 100 makes contact with the corresponding power socket 702 of connector 700, representing a live terminal and a neutral terminal. The earth spring 150 is positioned on the trench formed along the bottom of the slim inlet 100 and makes contact with the earth contact 704 of the connector 700 prior to the pin 130,140 coming in contact with the corresponding power socket 702. As indicated above, the size of the power pin can be the same as the size of the power pin in a standard C8 inlet. Similarly, the size of the power socket and the recess distance can be the same as the size and the recess distance of a standard C7 connector. In one embodiment, the earth spring 150 and the earth contact of the corresponding connector are clear from the power pins by more than about 4 mm. In the embodiment illustrated in FIG. 7, the earth spring 150 and the earth contact 704 of the corresponding connector are clear from the power pins by no less than about 2 mm. As noted above, embodiments can deviate from the above mentioned dimensions without departing from the true spirit of the invention.

Figure 8A:
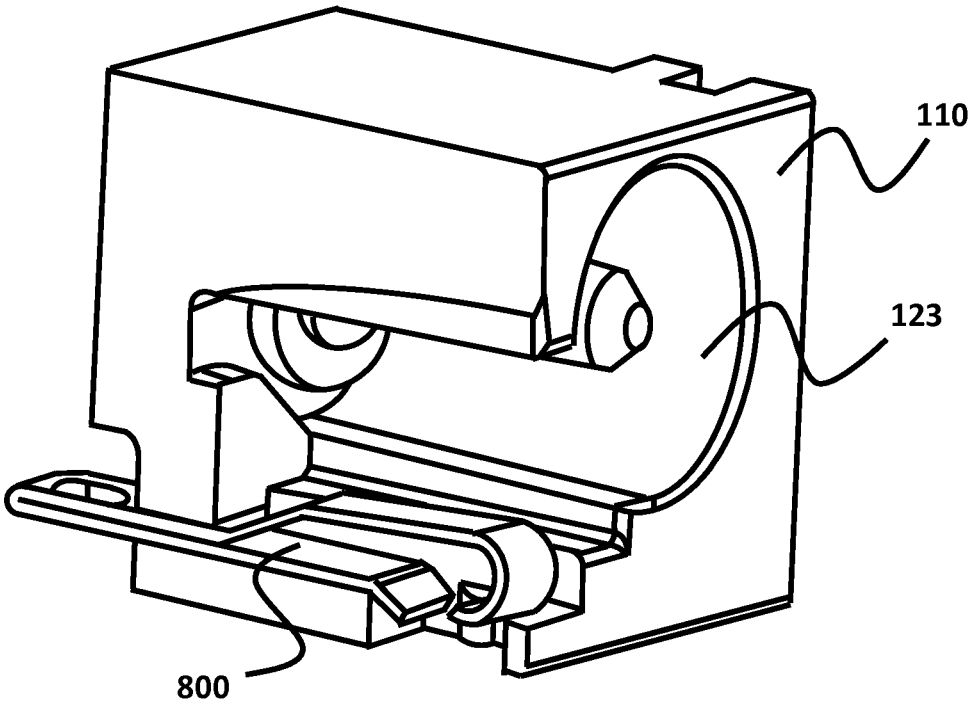
FIGS. 8A-8C illustrating an earth spring with a number of deficiencies, including a high impact angle between the earth spring of a slim inlet and the corresponding earth contact of a slim connector.
Figure 8B:
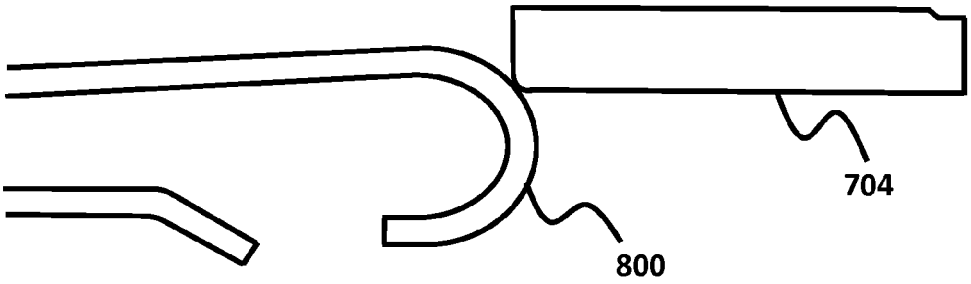
Figure 8C:
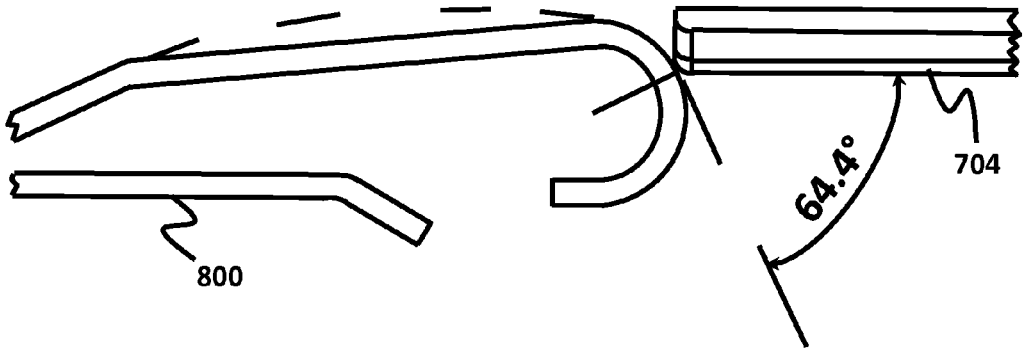

FIGS. 8A-C illustrate views of a design of an earth spring 800 that is not preferred for a number of reasons. First, the impact angle of earth spring 800 with the corresponding earth contact of a slim connector, such as the earth contact 706 of slim connector 700, is designed to be about 64 degrees. This high impact angle can cause the earth spring 800 to malfunction due to the earth spring 800 buckling or deforming, as illustrated in FIG. 8C, when the slim connector 700 is inserted into the slim inlet 100. The earth spring 800 also does not have a locking mechanism that retains the earth spring 800 in housing 110. Finally, because the earth spring 800 has no support that presses the earth spring 800 into the housing 110, directly pushing the earth spring 800 can cause deformation of the earth spring 800.

FIG. 8B further illustrates the earth spring 800 from FIG. 8A making contact with the earth pin contact 704 from slim connector 700 when being inserted into the slim inlet 100. FIG. 8C illustrates that the impact angle for earth spring 800 is about 64 degrees, which combined with the insertion force of the connector 700 being inserted into the slim inlet 100, results in the earth spring 800 bending and causing the earth spring 800 to malfunction.

Figure 9:
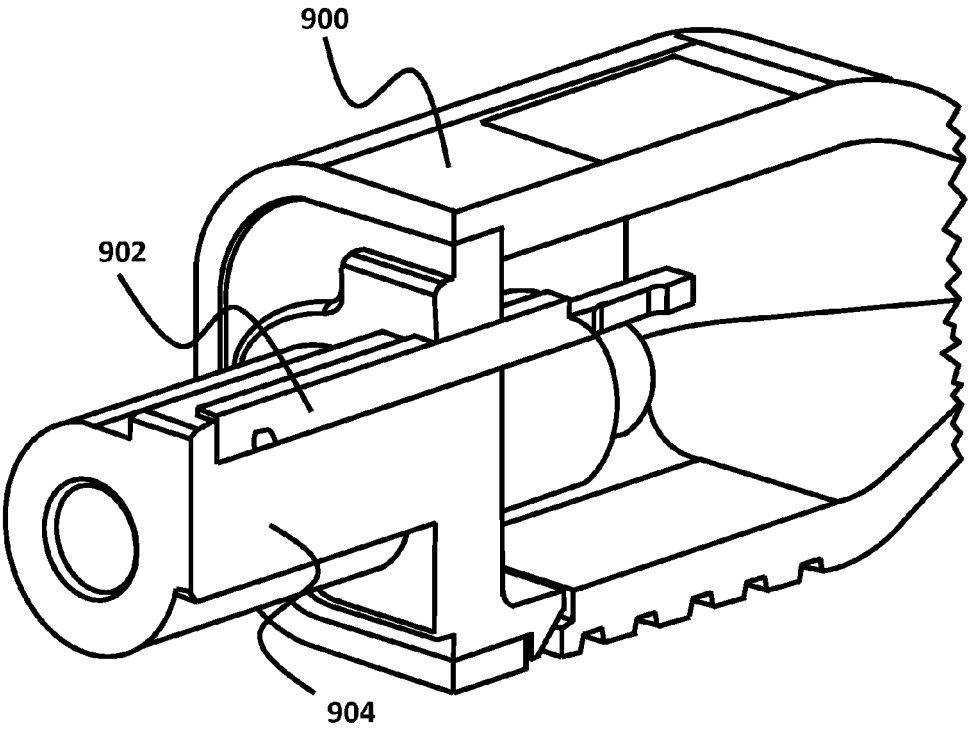
FIG. 9 illustrating a partial cross-sectional view of a slim connector having an earth contact that violates International Electrotechnical Commission guidelines.

FIG. 9 also illustrates a partial cross-sectional view of a connector 900 having an earth contact 902 that is not preferred because it does not comply with International Electrotechnical Commission (IEC) guidelines. In particular the earth contact 902 of the connector 900 is supported by insulation 904. According to IEC standards, the earth contact of a connector cannot be supported by insulation at the contact portion.

Embodiments disclosed herein address the high impact angle of the earth spring in a slim inlet as illustrated in FIGS. 8A-C and provide a slim connector that does not support the earth contact with insulation as illustrated in FIG. 9.

Figure 10A:
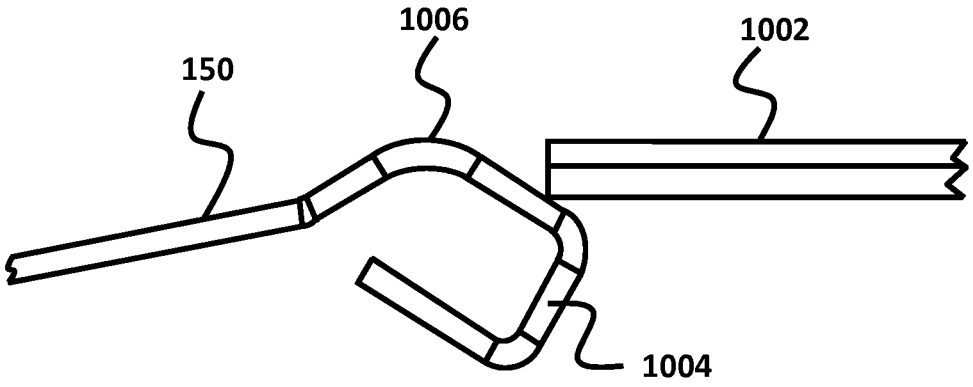
FIGS. 10A and 10B illustrating a detailed view of an earth spring in accordance with an embodiment, the earth spring having a hook shaped end that reduces the impact angle between the earth spring of a slim inlet and the corresponding earth contact of a slim connector.

FIG. 10A illustrates earth spring 150 in accordance with such embodiments. The earth spring 150 is comprised of a linearly, upward sloping portion attached, via a slightly curved and top most portion 1006, to a substantially rectangular hook shaped portion or end 1004. Other shapes can be used for the hook shaped portion 1004 aside from a substantially rectangular shape, as long as such other shapes do not result in the earth spring 150 catching on some portion of the slim connector when the slim connector is inserted or removed.

Figure 10B:
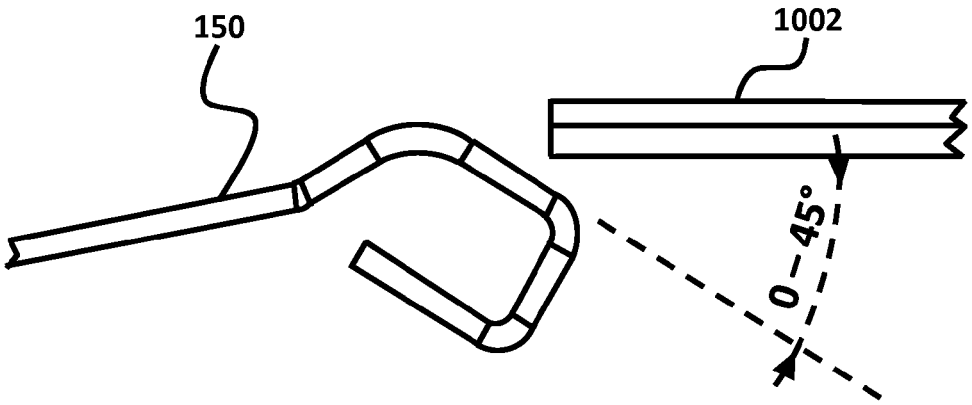

The earth pin contact 1002 of the slim connector makes an initial contact with the leading edge of the hook shaped portion 1004. The design of the earth spring 150, including the shape and orientation of the hook portion, reduces the impact angle between the earth spring 150 and the earth pin contact 1002. FIG. 10B illustrates that the design of the earth spring 150 has an impact angle of approximately 30 degrees, although the impact angle could be any angle between approximately 0 degrees and approximately 45 degrees. As the slim connector is pushed and inserted into the slim inlet, the earth spring 150 is pushed down and biased upward, thereby maintaining a connection between the earth spring 150 of the slim inlet and the earth contact 1002 of the slim connector.

Figure 11:
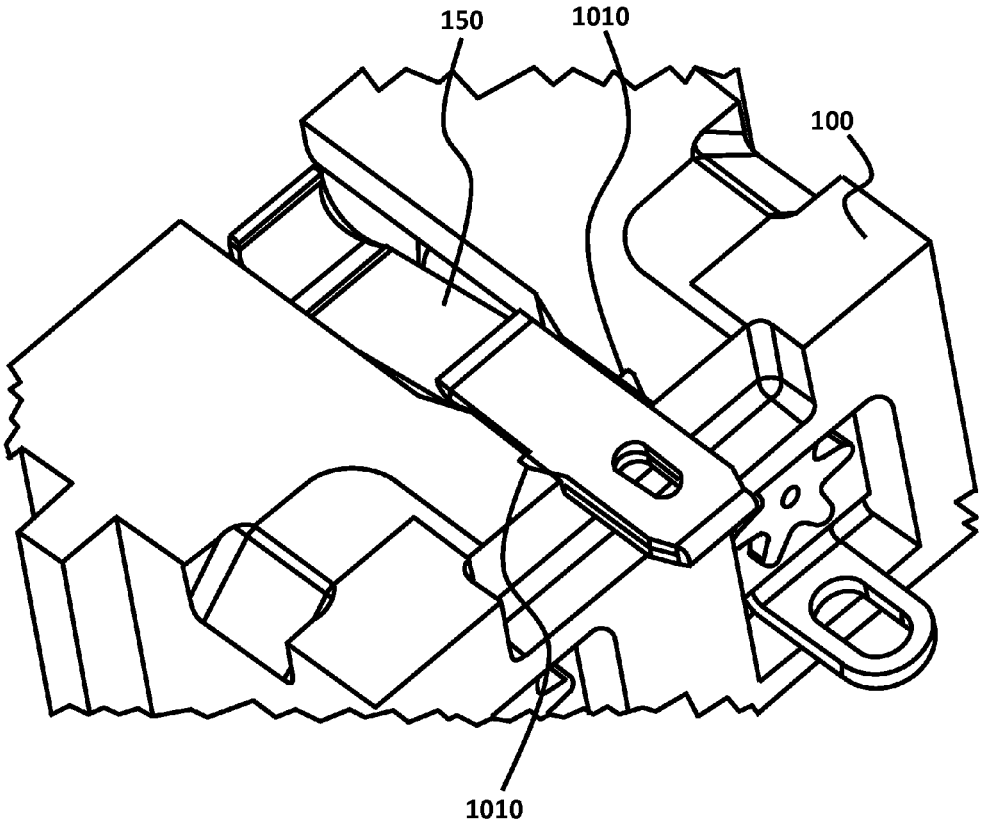
FIG. 11 illustrating a partial, bottom view of the earth spring from FIG. 10A assembled in a slim inlet.

FIG. 11 illustrates a partial, bottom view of earth spring 150 assembled in slim inlet 100. Embodiments of the earth spring 150 can further comprise a latch lock 1010 that helps retain the earth spring 150 in its position and prevents the earth spring 150 from moving due to insertion forces.

Figure 12A:
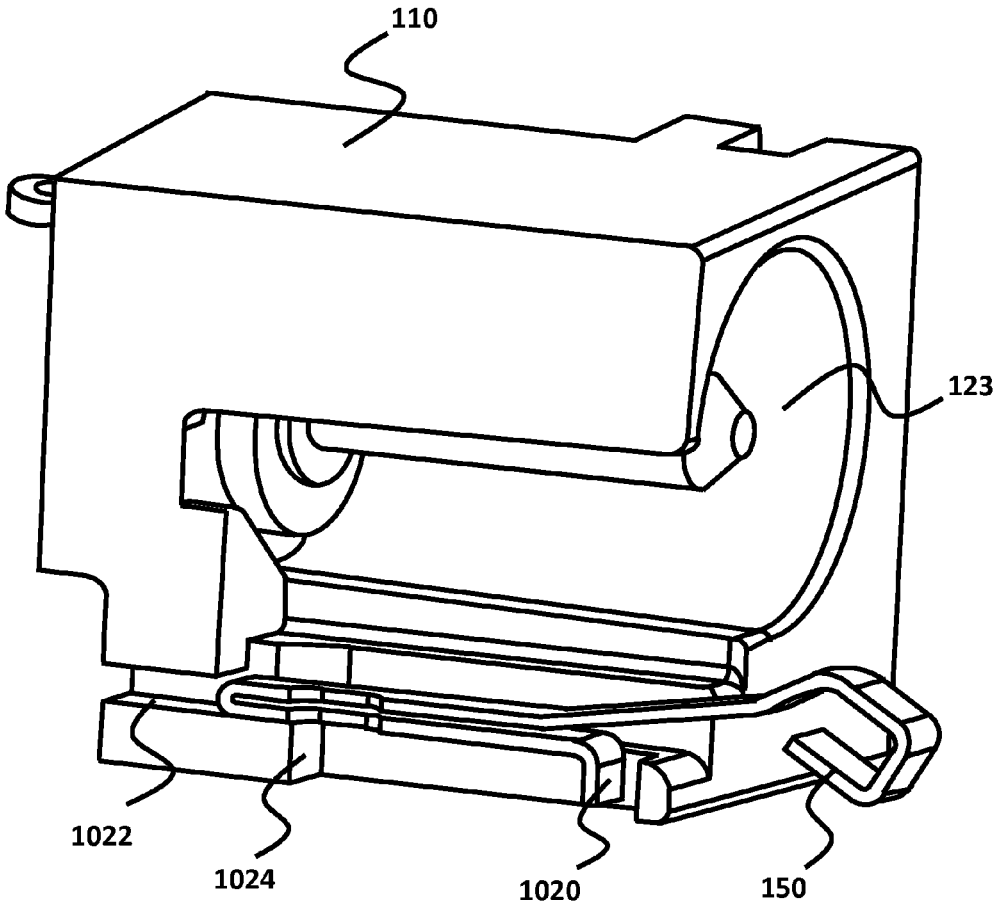
FIGS. 12A and 12B illustrating a partial, cross-sectional view of the earth spring from FIG. 10A when partially assembled and when fully assembled in the housing of the slim inlet.
Figure 12B:
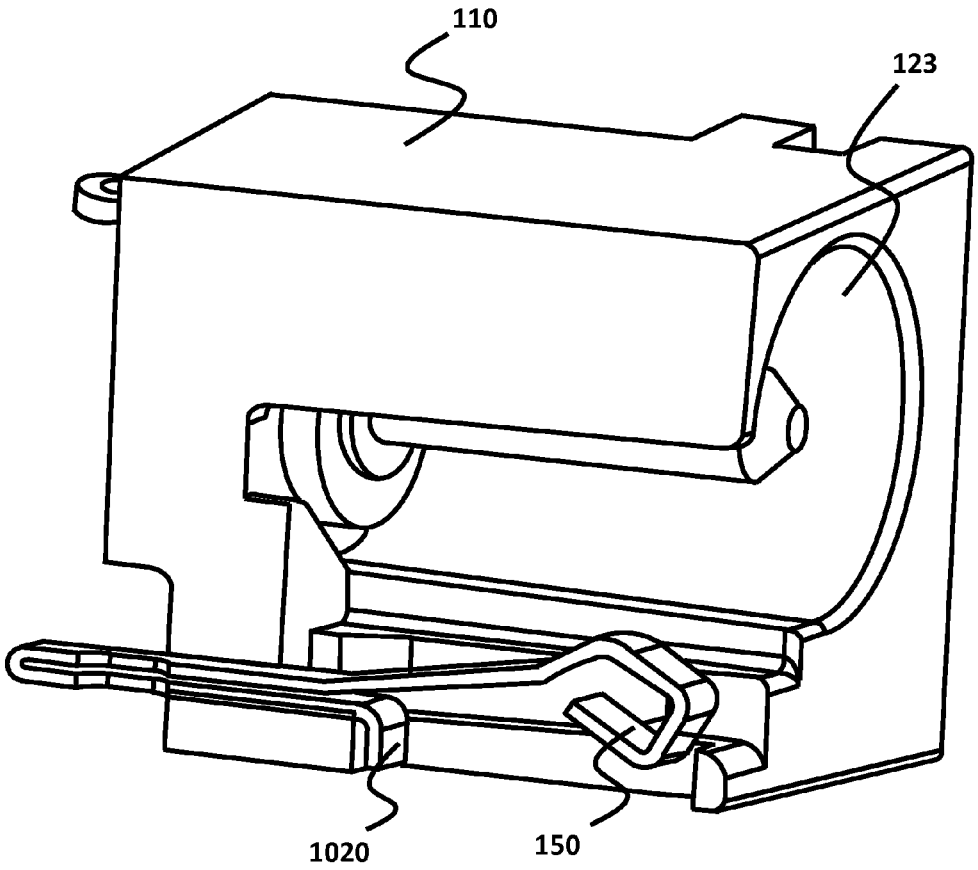

FIG. 12A illustrates a partial, cross-sectional view of the earth spring 150 being inserted into the housing 110 of slim inlet 100 during assembly of the slim inlet 100. The earth spring 150 is inserted by pushing the end of the earth spring 159 (opposite the hook shaped end) through opening 1022 until the stopping hook 1020 abuts against the earth spring support area 1024. FIG. 12B illustrates a partial, cross-sectional view of the earth spring 150 when fully inserted into housing 110. The stopping hook 1020 retains the earth spring 150 in its position and prevents the earth spring 150 from moving in response to the slim connector being inserted into the housing 110 of slim inlet 100. As indicated above, the support provided by the stopping hook 1020 prevents the earth spring 150 from deforming due to the insertion forces of the slim connector.

Figure 13:
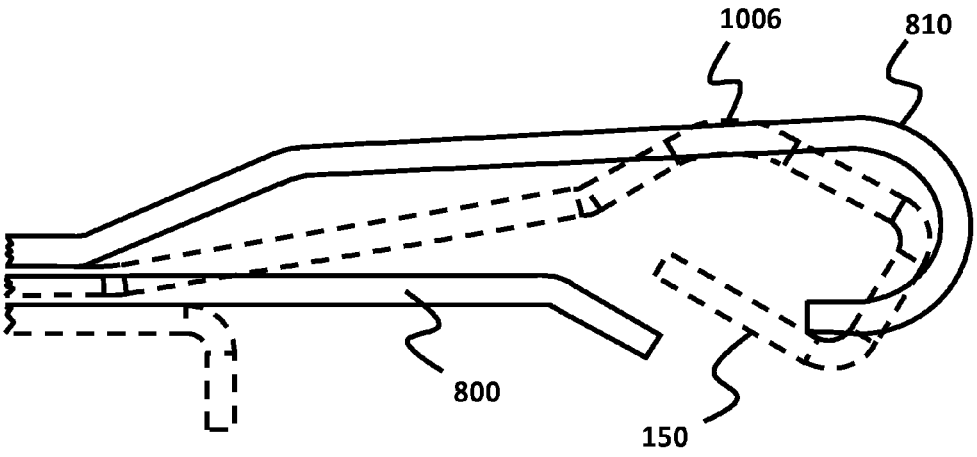
FIG. 13 illustrating the profiles of the earth spring from FIG. 8A and the earth spring from FIG. 10A.

FIG. 13 compares the profile of earth spring 800, having an impact angle of about 64 degrees, and the profile of an embodiment of the improved earth spring 150, having an impact angle of about 30 degrees, although the impact angle could be any angle between approximately 0 degrees and approximately 45 degrees. In earth spring 150, the contact point between the earth spring 150 and the earth contact of the slim connector is at the top most point 1006 of the hook portion (hook shaped end) of the earth spring 150. In contrast, in earth spring 800 the contact point is relatively further out at contact point 810.

Figure 14:
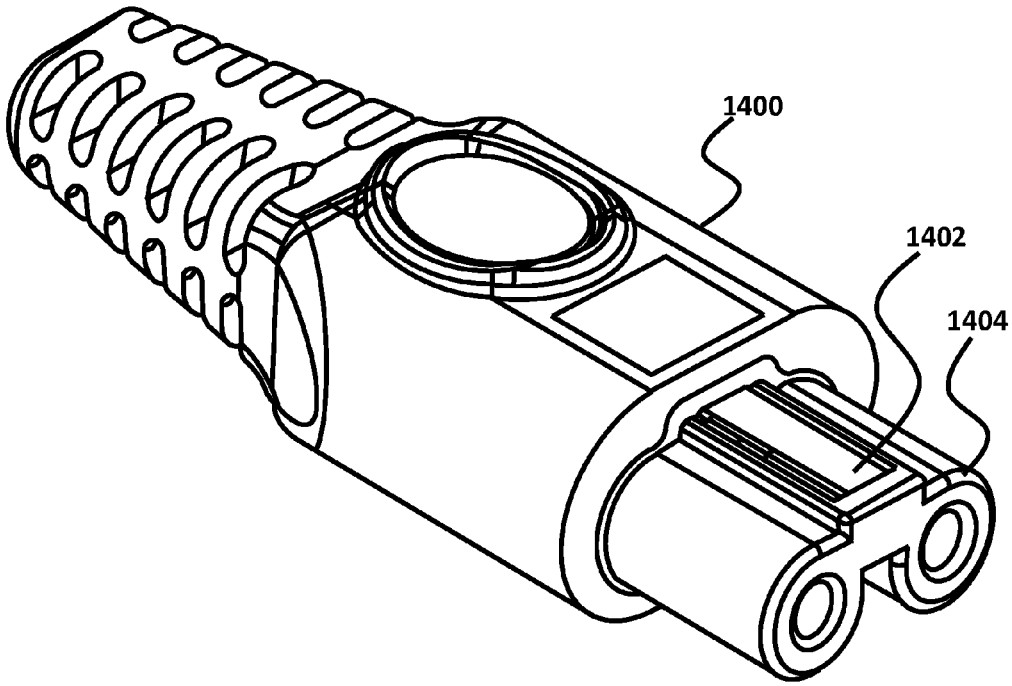
FIG. 14 illustrating a slim C5 connector in accordance with an embodiment.
Figure 15:
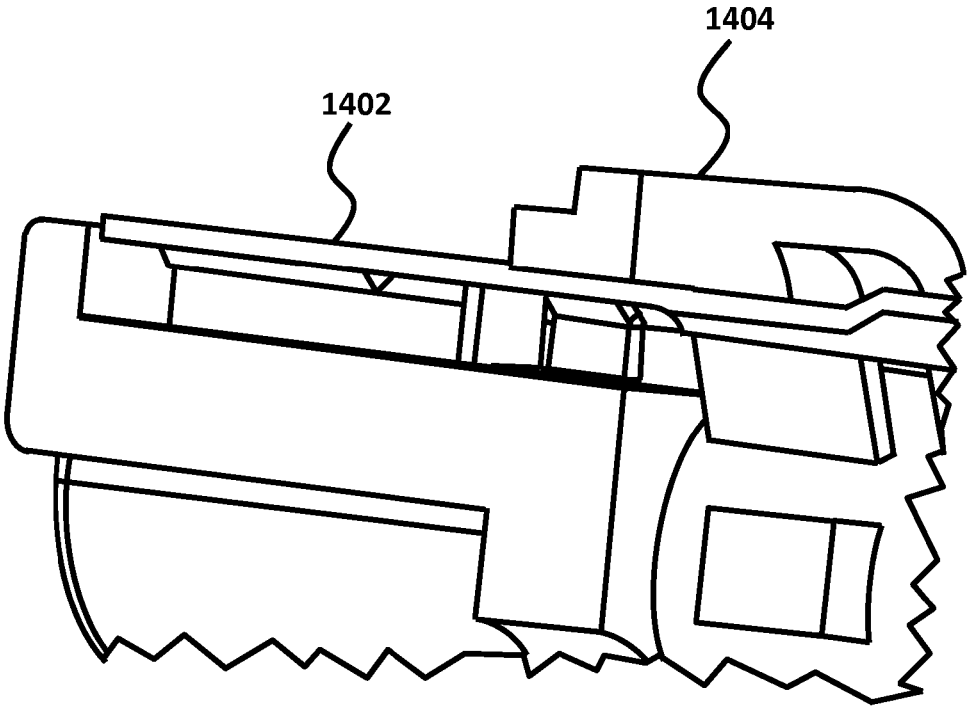
FIG. 15 illustrating a partial, cross-sectional view of the slim connector from FIG. 14, showing that the earth contact of the slim connector is not supported by insulation.

FIG. 14 illustrates a slim C5 connector 1400 in accordance with an embodiment. In particular, connector 1400 includes an earth contact 1402 that is not supported by the insulation of the front end 1404 of connector 1400. FIG. 15 illustrates a partial, cross-sectional view of the front end 1404 of the plug 1400, showing that the earth contact 1402 is not supported by insulation. In an embodiment, the connector 1400 is a 2-pole straight connector, such as the VAC7S connector made by VOLEX Group plc. The earth contact 1402 can be comprised of a crimping earth pin that fits into a slot opening on the bottom of the front end 1404 of connector 1400.

Figure 16:
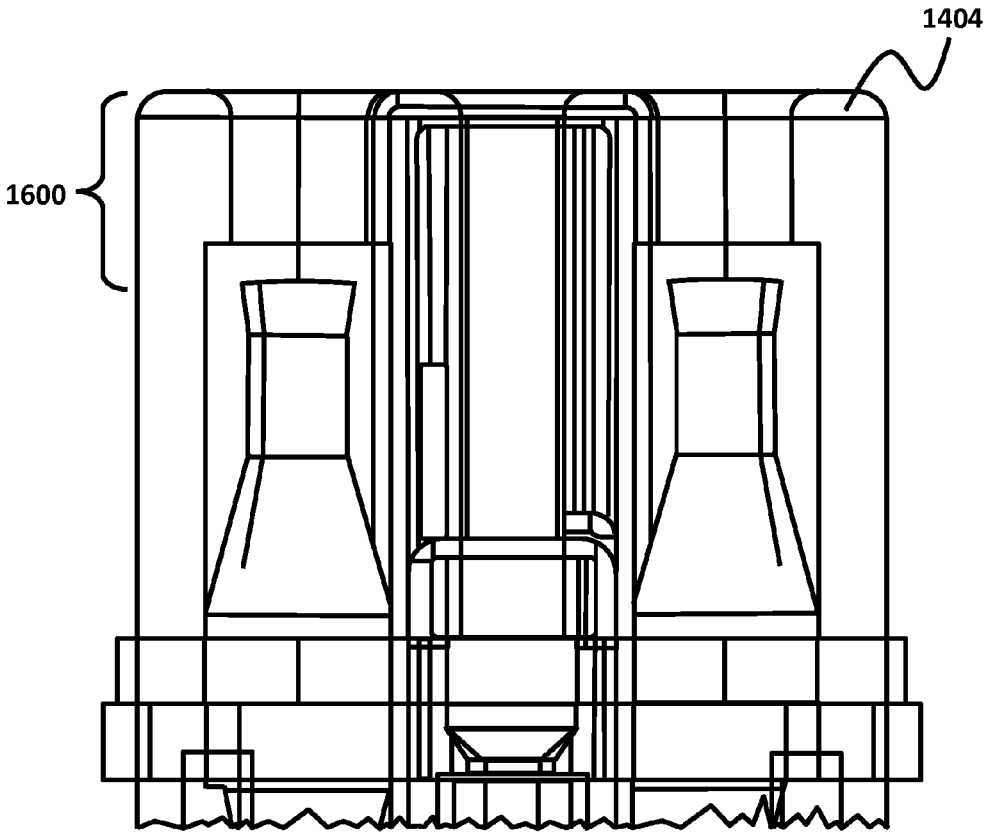
FIG. 16 illustrating a partial, top-down view of the front end of the slim connector from FIG. 14.

FIG. 16 illustrates a partial, top-down view of the front end 1404 of the connector 1400. In connector 1400, the live terminal and the neutral terminal are assembled deeper by approximately 1 mm, changing the range of the terminal assembly from about 3-3.8 mm to about 4-4.8 mm. The distance 1600 is substantially equal to 4 mm. After shifting the line and neutral terminal assembly deeper, and combined with the improved earth spring 150, the connector 1400 can achieve a good make-first-and-break-last earth contact with the earth spring 150 of slim inlet 100. As discussed above, FIG. 4 illustrates how the shift of the line terminal and the neutral terminal assembly allows a make-first-and-break-last earth contact, with the ground spring coming into contact with the earth pin contact prior to the power pins coming into contact with the corresponding power terminals. As illustrated in FIGS. 5 and 6, even when the connector is inserted into the slim inlet in the upper extreme position or in the lower extreme position, the make-first-and-break-last earth contact is maintained. Finally, as noted above, embodiments can deviate from the dimensions presented herein without departing from the true spirit of the invention. In the present case, assembling the live terminal and the neutral terminal slightly deeper helps ensure a make-first-and-break-last earth contact with the earth spring 150.

While the present disclosure illustrates and describes a preferred embodiment and several alternatives, it is to be understood that the techniques described herein can have a multitude of additional uses and applications. Accordingly, the invention should not be limited to just the particular description and various drawing figures contained in this specification that merely illustrate various embodiments and application of the principles of such embodiments.

What is claimed is:

1. A power inlet for an electric connector, comprising:

a housing having a front side and a back side with a recessed cavity formed within the housing starting from an opening in a surface of said front side, wherein said recessed cavity has a first substantially circular portion on a first side, a second substantially circular portion on a second side, a substantially indented channel connecting said first and second substantially circular portions, and an elongated trench recessed in a sidewall of said substantially indented channel;

a live pin having a first end protruding out of said housing into said first substantially circular portion, wherein said live pin has a substantially cylindrical shape;

a neutral pin having a first end protruding out of said housing into said second substantially circular portion, wherein said neutral pin has a substantially cylindrical shape; and an earth spring having a first end protruding out of said housing into said elongated trench, wherein a portion of said first end of said earth spring is exposed in said trench and is configured to not contact a surface of said trench when deflected by an earth pin of a mating connector.

2. The inlet of claim 1, further comprising:

a hook portion of said earth spring that extends out from said first end of said earth spring distal from said housing and bends under said first end of said earth spring.

3. The inlet of claim 2, wherein said hook portion of said earth spring further includes a raised portion of said earth spring that juts out from said trench.

4. The inlet of claim 1, wherein said raised portion contacts said earth pin at an angle of between approximately 0 degrees to approximately 45 degrees relative to the earth pin.

5. The inlet of claim 1, wherein said earth spring protrudes further out of said housing than said live pin and said neutral pin to facilitate make-first-and break-last earth contact with the earth pin.

6. The inlet of claim 1, further comprising:

a contact pad connected to a second of end of said live pin that is exposed through an opening formed in said back side of said housing.

7. The inlet of claim 6, wherein said contact pad comprises:

a flat base that rests on said second end of said live pin in a plane substantially perpendicular to a longitudinal axis of said live pin.

8. The inlet of claim 7, wherein said contact pad further comprises:

a projection that extends outward from an end of said base in a plane substantially parallel to said longitudinal axis of said live pin in a direction that is distal from said live pin.

9. The inlet of claim 8, further comprising:

an end of said projection that extends out of said opening in said back side of said housing having an aperture formed in an exposed portion of said end.

10. The inlet of claim 1, further comprising:

a contact pad connected to a second end of said neutral pin that is exposed through an opening formed in said back side of said housing.

11. The inlet of claim 10, wherein said contact pad comprises:

a flat base that rest on said second end of said neutral pin in a plane substantially perpendicular to a longitudinal axis of said neutral pin.

12. The inlet of claim 11, wherein said contact pad further comprises:

a projection that extends outward from an end of said base in a plane substantially parallel to said longitudinal axis of said neutral pin in a direction that is distal from said neutral pin.

13. The inlet of claim 12, further comprising:

an end of said projection that extends out of said opening in said back side of said housing having an aperture formed in an exposed portion of said end.

14. The inlet of claim 1, further comprising:

a second end of said earth spring that extends out of said back side of said housing.

15. The inlet of claim 14, further comprising:

an exposed portion of said second end of said earth spring that has an opening formed through said exposed portion.

16. The inlet of claim 1, wherein said recessed cavity is shaped to prevent electrically incompatible connectors from being connected to said live pin and neutral pin of said connector.

17. The inlet of claim 1, wherein said live pin and said earth spring are spaced apart in said housing to prevent electrically incompatible connectors from being used with said connector.

18. A C6 power inlet, comprising:

a housing having a size substantially equivalent to a size of a standard C8 power inlet and a shape substantially equivalent to a shape of the standard C8 power inlet, the housing forming a recessed cavity having a first cylindrical opening, a second cylindrical opening, and a trench formed along a bottom of a longitudinal axis of the housing and positioned between the first cylindrical opening and the second cylindrical opening;

a live pin enclosed within the first cylindrical opening and protruding out of a back plane of said housing;

a neutral pin enclosed within the second cylindrical opening and protruding out of the back plane of said housing; and a cantilevered earth spring positioned in the trench, a first end of the earth spring forming a hook portion raised above the trench and protruding beyond the live pin and the neutral pin, wherein the hook portion is reflectable and configured to reduce an impact angle between the earth spring and an earth pin contact of a C5 connector and facilitate a make-first-and-break-last earth contact with the earth pin contact.

19. The C6 power inlet as recited in claim 18, wherein a shape of the recessed cavity prevents other types of connectors from being connected to the live pin and the neutral pin.

20. The C6 power inlet as recited in claim 18, wherein the earth spring further comprises a latch lock positioned near a second end of the earth spring near the back plane of the housing, the latch lock retaining the earth spring in position by applying a force against a first side wall and a second side wall of the trench.

21. The C6 power inlet as recited in claim 18, wherein the earth spring further comprises a stopping hook formed by bending a first end of a bottom portion of the earth spring downward at a substantially 90 degree perpendicular to the longitudinal axis of the earth spring, the stopping hook abutting against a support area formed along the trench.

22. A power inlet for an electric connector, comprising:

a live pin;

a neutral pin;

a housing enclosing the live pin and the neutral pin, the housing having a front side and a back side with a recessed cavity formed within the housing starting from an opening in a surface of said front side, the housing including an elongated trench formed between the live pin and the neutral pin and recessed along a bottom plane of the housing; and an earth spring having a first end protruding out of said housing into said elongated trench, wherein a portion of said first end of said earth spring is exposed in said trench, a hook portion of said earth spring extending out from said first end of said earth spring distal from said housing and bending under said first end of said earth spring, wherein said hook portion of said earth spring further includes a raised portion of said earth pin that juts out from said trench.

* * * * *